US005744197A

United States Patent [19]

Van Eck

[11] Patent Number: 5,744,197

[45] Date of Patent: Apr. 28, 1998

[54] METHOD OF PROTECTING ALUMINUM SKINS OF LAND VEHICLES FROM CORROSION

[75] Inventor: Darrell Van Eck, West Dundee, Ill.

[73] Assignee: J. B. Faith Co., Elgin, Ill.

[21] Appl. No.: 897,432

[22] Filed: Jul. 21, 1997

Related U.S. Application Data

[63] Continuation-in-part of Ser. No. 702,845, Aug. 26, 1996, abandoned.

[51] Int. Cl.[6] ..... B05D 3/00

[52] U.S. Cl. ..... 427/328; 427/367

[58] Field of Search ..... 106/14.33; 427/328, 427/367

[56] References Cited

U.S. PATENT DOCUMENTS

| | | | |
|---|---|---|---|
| 1,410,391 | 3/1922 | Edison | 106/14.33 |
| 3,711,347 | 1/1973 | Wagner et al. | 156/91 |
| 3,983,304 | 9/1976 | Sekhorn | 428/460 |
| 4,360,384 | 11/1982 | Mckaveney et al. | 106/1.12 |
| 4,626,283 | 12/1986 | Martins et al. | 106/14.74 |
| 4,657,460 | 4/1987 | Bicn | 411/258 |
| 5,193,958 | 3/1993 | Day | 411/82 |
| 5,304,023 | 4/1994 | Toback et al. | 411/387 |

*Primary Examiner*—Benjamin Utech
*Attorney, Agent, or Firm*—Brinks Hofer Gilson & Lione

[57] ABSTRACT

A method is disclosed of protecting a land or roadway vehicle body from surface corrosion which causes pitting, blistering, and other defects in paint at the joints in the skin, where the body surface is comprised of dissimilar metals in its skins and stringers and in the fasteners therefor. Roadway vehicles such as ambulances and fire trucks often have aluminum skins fastened with stainless steel screws, bolts, or rivets to aluminum structural members to save weight, but corrosion thereof is a persistent problem. The new method comprises using an anti-oxidant, a heavy grease compound with metallic zinc dispersed therein as dust or powder, such as electrical joint compound, as a bedding compound applied to surfaces of the fasteners or to the insertion apertures therefor before assembly. In one commercial form, the compound comprises about 51–53% by weight zinc, about 36% by weight refined heavy paraffinic distillate, and about 11–13% by weight aluminum stearate. The assembled surfaces will resist corrosion better, and for years longer, than surfaces assembled by other methods.

18 Claims, 1 Drawing Sheet

METHOD OF PROTECTING ALUMINUM SKINS OF LAND VEHICLES FROM CORROSION

This application is a continuation-in-part of application Ser. No. 08/702,845, filed Aug. 26, 1996, now abandoned.

BACKGROUND OF THE INVENTION

1. Field of the Invention

The present invention relates to anti-corrosion methods and devices for use in fastening metals where the fastener used is of a different metal than that being fastened together. Anti-oxidation compounds for preventing oxidation of dissimilar electrical conductors are known, and such compounds are occasionally used in marine environments for connecting dissimilar metals.

2. Background of the Invention

Corrosion in the painted surfaces of land vehicles such as ambulances and fire trucks has been a persistent problem for the vehicle manufacturing and body repair industries concerned with them. Such vehicles use skins and stringers of aluminum (including aluminum alloys) to save weight for more important uses such as monitoring and communications equipment, pumps, ladders, and the like. Such skins often corrode, surprisingly, to the discomfort of makers and users alike. The corrosion problem is heretofore dealt with by treating the symptoms, not the cause. It is believed that stainless steel screws and rivets react with the aluminum skin and stringers when wet and in the presence of salt. Only by isolating the metal parts from one another or by providing a sacrificial anode for each fastener can the problem be avoided.

Prior U.S. patents addressing the corrosion problem include U.S. Pat. No. 3,711,347 that shows the use of a mastic sealing and locking ring about the underside of a fastener head. U.S. Pat. No. 4,657,460 precoats an upper portion of a screw thread with a thermo-setting adhesive, such as an epoxy, which is forced to the underside of the head. U.S. Pat. No. 5,304,023 discloses using a sealant or adhesive coating under the head of a screw for fastening building roof panels. U.S. Pat. No. 5,193,958 refers to zinc and other fillers for anti-corrosion mastic coatings on screws used to fasten metal building and roof panels to metal building frames. U.S. Pat. No. 4,626,283 discloses and compares many corrosion-inhibiting compounds, including zinc and zinc oxide materials, used in paints for iron, steel, aluminum, and other metals, but not for joints thereof.

SUMMARY OF THE INVENTION

The present invention employs zinc-rich compounds, such as electrical joint compound, wherein zinc dust or powder is dispersed in a petroleum base such as a heavy grease, or a paraffinic base, in a new use: to bed metal fasteners to prevent corrosion in land vehicle bodies made of skins and stringers of dissimilar metals. The compound may include a fatty acid ester, its salt, or a mixture thereof as a minor part. The fastener is coated in part with the bedding compound before or as it is inserted into the skin to join the skin firmly to the stringers of the vehicle body. Excess material is cleaned from the vehicle surface. The zinc seems to prevent corrosion of the aluminum skin for extended periods compared to assemblies not using such bedding compound.

All percentages stated are by weight unless otherwise specifically stated.

THE PREFERRED EMBODIMENTS

The method of the present invention uses any known or hereafter developed heavy oil or paraffin compound rich in zinc dust or powder to prevent, reduce, and delay corrosion in aluminum-skinned roadway vehicles assembled using stainless steel fasteners. Such construction is frequently used in ambulance and fire truck bodies to save weight over steel structures yet provide a durable, paintable surface which generally resists corrosion. Manufacturers of such vehicles have warranted their vehicle bodies against corrosion, yet paint around the fasteners and joints too often will pit, blister, and lift for unknown reasons after too short a time. Because the appearance of such vehicles is usually a source of pride of the volunteers and professionals manning them and of the communities in which they are used, visible pitting and other defects in the paint finish are unacceptable. Warranty claims result, leading to expensive disassembly, cleaning, refinishing, and reassembly steps to be undertaken by local specialty body shops; but repeat claims are too common even after local repair.

Such corrosion is believed to be caused by an electrolytic reaction between the dissimilar aluminum of the vehicle body skins and stringers and the stainless steel fasteners therefor in the presence of moisture, particularly moisture laden with roadway salt. The method of the present invention is to bed the stainless steel fasteners upon assembly of the skins in a bedding compound that includes a petroleum base such as heavy oil (grease) or paraffinic distillate containing a major part of metallic zinc as dust or powder. An amount of a fatty acid ester or its salt such as aluminum stearate or similar substance may also be included in the compound.

In particular, the bedding compound includes at least about 20% by weight, and preferably from about 20% to about 50% of a petroleum base, at least about 40%, and preferably from about 40% to about 60% of metallic zinc as dust or powder. The compound may also include at least about 5% by weight and, preferably from about 5% to about 20% of a fatty acid ester, its salt or a mixture thereof. The cation of the salt of the fatty avid ester is preferably aluminum. In a preferred embodiment the compound includes from about 30% to about 40% by weight of a petroleum base, from about 45% to about 55% of metallic zinc dust or powder, and from about 10% to about 15% of a fatty acid ester, its salt, or mixtures thereof. The petroleum base is preferably paraffinic and may include heavy oils, refined heavy paraffinic distillate, and paraffin oils.

In one commercial form, the bedding compound comprises about 51–53% by weight zinc, about 36% refined heavy paraffinic distillate, and about 11–13% aluminum stearate.

Figure 1:
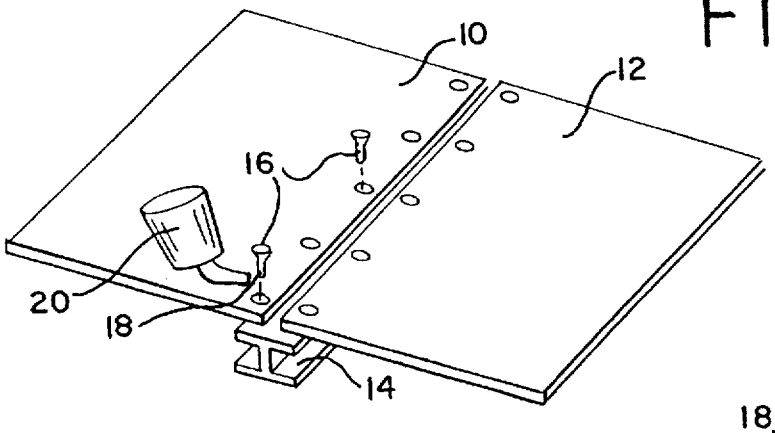
FIG. 1 is an exploded perspective view of a vehicle skin and stringer being assembled with stainless steel fasteners and bedding compound according to the method of the present invention.
Figure 5:
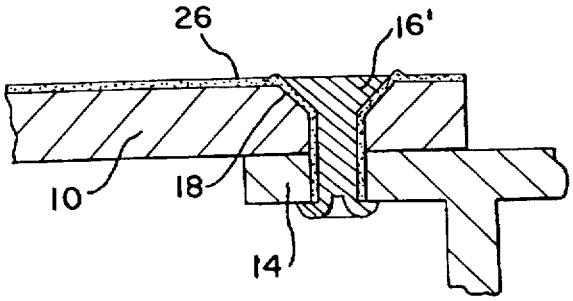
FIG. 5 is a detail, cutaway side view of the assembly of FIGS. 1, 2, and 3, using a rivet as an alternative fastener, after assembly.

FIG. 1 shows the environment of the method of the present invention. Skin panels 10, 12 of a roadway vehicle, the panels being made of aluminum (including any aluminum alloy), are to be fastened to an aluminum stringer 14 by stainless steel fasteners 16. Other metals may also be used as desired in these elements, but these are the most commonly used. The skins and stringers of the vehicle may be in any form and need not be flat or straight as shown, and they may be placed with overlaps at their edges. They commonly are pre-painted, as at 16, usually prior to drilling and countersinking and generally before assembly. Also, the fasteners 16 may be self-tapping or self-drilling screws, threaded bolts, blind or pop rivets as at 16' in FIG. 5, or the like, as may be convenient to or specified by the manufacturer or repair shop.

Figure 2:
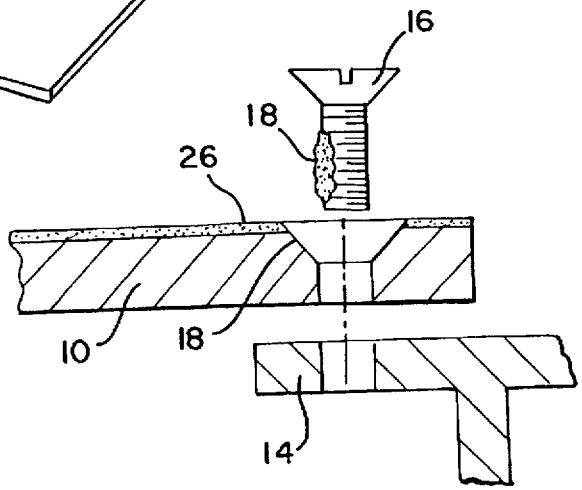
FIG. 2 is a detail, cutaway side view of the exploded assembly of FIG. 1.

In accordance with the present invention, the fasteners 16 may but need not have special pre-coatings, rims, channels, or hollows. Rather, just prior to assembly, each fastener receives on at least a portion of its lower shank adjacent the lowest or distal end, opposite the head, a sufficient amount of bedding compound 18 to bed the shank and head of the fastener as it is inserted into and fully secured in the skin and stringer. An application gun or squeeze bottle 20 may be used to apply a small amount of the bedding compound 18 onto the end part 22 of the fastener 16 that is first inserted into the skin 10, as shown in FIG. 2. Alternatively, the bedding compound may be applied to the fastener indirectly, by applying it into a hole in the skin and stringer to contact and coat the fastener as it is inserted, to the same effect. The goal is to apply a sufficient amount of bedding compound 18 to coat all the threads and the underside of the head of the fastener, if any, where they contact the skin 10 and stringer 14. If a small amount of bedding compound 18 is squeezed up from the shank and evenly about the head of the fastener upon full insertion, as shown at 24 in FIG. 3, a proper amount has likely been used.

Figure 3:
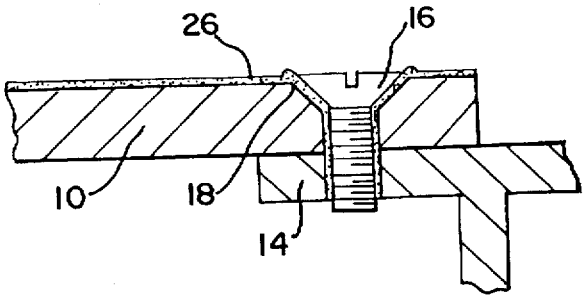
FIG. 3 is a detail, cutaway side view of the assembly of FIGS. 1 and 2 after some steps of assembly according to the method of the invention.
Figure 4:
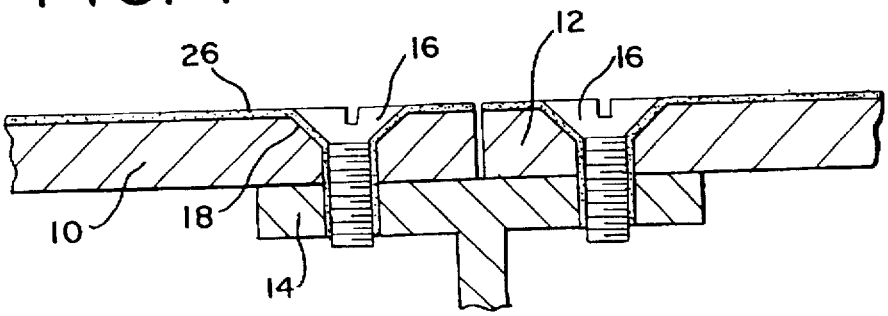
FIG. 4 is a detail, cutaway side view of the assembly of FIGS. 1, 2, and 3 after assembly.

The amount of compound 18 to be applied to each fastener will vary with the type of fastener, the thicknesses of the skin and stringer parts, and tolerances in any drilling and tapping, but is not critical and is usually easily determined by the assembler. Excess compound 24 is wiped from the fasteners 16 or 16' and the painted surfaces 26 of the skin 10, 12. The finish coat of paint 26 or like material is generally pre-applied to the skin sections of the vehicle before their assembly, as shown in FIGS. 2–4.

Variations in the materials used will not depart from the scope and spirit of the invention of this method of protecting dissimilar metal skins, stringers, and fasteners from corrosion and damage to paint. All such variations as come within the scope of the appended claims come within the scope of this invention.

I claim as my invention:

1. A method, for use upon a body of a vehicle and having at least one metal skin and stringer that are assembled together with at least one fastener of a dissimilar metal inserted into said skin and stringer, comprising the steps of:

applying to a distal end of at least one said fastener an amount of a bedding compound generally sufficient to coat the fastener in all its areas which contact the metal skin and stringer, the bedding compound comprising metallic zinc suspended in a petroleum base;

inserting the fastener, before significant hardening of the bedding compound, into and through portions of the skin and stringer of said vehicle body and securing the fastener therein; and removing from the surface of the skin and from the exposed surface of the fastener substantially all said bedding compound that is left after securing the fastener.

2. The method of claim 1 wherein the bedding compound further comprises a fatty acid ester, its salt, or mixtures thereof.

3. The method of claim 1 wherein the bedding compound includes at least about 40% by weight of zinc dust or powder and at least about 20% by weight of petroleum base.

4. The method of claim 3 wherein the bedding compound further comprises also at least about 10% by weight of a fatty acid ester, its salt, or mixtures thereof.

5. The method of claim 1 wherein the compound is applied to the distal end of the fastener by applying it first to the part of the skin or stringer where the fastener first enters same.

6. The method of claim 1 wherein the land vehicle in which the bedding compound is used is selected from the group consisting of ambulances and fire trucks.

7. The method of claim 1 wherein the fastener has screw threads on a shank portion thereof.

8. The method of claim 7 wherein the fastener is a threaded bolt.

9. The method of claim 1 wherein the fastener is a rivet.

10. A method for use upon a body of a vehicle, the body being comprised of metal skins and stringers and fasteners for assembling said skins to said stringers, wherein said skins and stringers are of a metal dissimilar from that of said fasteners, the method comprising the steps of:

applying a compound, which is comprised principally of finely divided metallic zinc suspended in a petroleum base, to at least one of said fasteners in such amount and location as to effectively coat those portions thereof that upon installation contact and engage the skins and stringers of the vehicle body; and securing the skin and stringers together with said fasteners prior to significant hardening of the compound.

11. The method of claim 10 wherein the compound further comprises a minor part of a fatty acid ester, its salt, or mixtures thereof.

12. The method of claim 11 wherein the compound comprises at least about 40% by weight of finely divided zinc, at least about 20% by weight of petroleum base, and at least about 5% by weight of a fatty acid ester, its salt, or mixtures thereof.

13. The method of claim 10 wherein the compound comprises from about 40% to about 60% by weight of zinc and from about 20% to about 40% by weight of petroleum base.

14. The method of claim 10 wherein the vehicle in which the compound is used is an ambulance.

15. The method of claim 10 wherein the compound is used with a vehicle body having a skin and stringers of aluminum and at least one fastener of stainless steel.

16. The method of claim 10 wherein the vehicle in which the bedding compound is used is a fire truck.

17. The method of claim 10 wherein the vehicle in which the bedding compound is used is an emergency rescue vehicle.

18. The method of claim 10 further comprising the step of wiping substantially all of the compound from the surface of the skin and from the exposed surface of the fasteners after said fasteners are fully inserted.

* * * * *